US008157130B2

(12) United States Patent
Murayama et al.

(10) Patent No.: US 8,157,130 B2
(45) Date of Patent: Apr. 17, 2012

(54) GAS CARTRIDGE

(75) Inventors: Keijiro Murayama, Tokyo (JP); Katsuhiko Murayama, Tokyo (JP); Jyunichi Tamura, Tokyo (JP); Masakazu Konishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 993 days.

(21) Appl. No.: 11/657,699

(22) Filed: Jan. 25, 2007

(65) Prior Publication Data

US 2007/0295727 A1 Dec. 27, 2007

(30) Foreign Application Priority Data

Jan. 27, 2006 (JP) ..... P. 2006-019119
Feb. 27, 2006 (JP) ..... P. 2006-051086
Mar. 30, 2006 (JP) ..... P. 2006-095386
May 12, 2006 (JP) ..... P. 2006-133662
Nov. 8, 2006 (JP) ..... P. 2006-303323

(51) Int. Cl.
*B65D 35/28* (2006.01)
*B65D 35/56* (2006.01)
*B65D 35/00* (2006.01)

(52) U.S. Cl. ..... 222/95; 222/105; 222/106

(58) Field of Classification Search ..... 220/495.04, 220/581, 560, 592, 668, 639, 651, 918, 919; 222/95, 96, 97, 386.5, 105, 106, 402.1; 347/21; 206/0.6; 140/20
See application file for complete search history.

(56) References Cited

U.S. PATENT DOCUMENTS

| | | | | |
|---|---|---|---|---|
| 3,202,319 | A * | 8/1965 | Howard | 222/41 |
| 3,389,833 | A * | 6/1968 | Ramis | 222/95 |
| 3,721,371 | A | 3/1973 | Dolveck | |
| 3,905,517 | A * | 9/1975 | Friedrich et al. | 222/95 |
| 3,979,025 | A * | 9/1976 | Friedrich et al. | 222/95 |
| 4,013,195 | A | 3/1977 | Ferris | |
| 4,095,724 | A | 6/1978 | Perusco | |
| 4,403,722 | A | 9/1983 | Nikolich | 227/8 |
| 4,415,099 | A * | 11/1983 | Paris | 222/95 |
| 5,069,590 | A | 12/1991 | Stoffel | |
| 5,115,944 | A * | 5/1992 | Nikolich | 222/94 |
| 5,337,923 | A * | 8/1994 | Lugez et al. | 222/183 |
| 6,092,566 | A * | 7/2000 | Yazawa et al. | 141/20 |
| 6,328,409 | B1 | 12/2001 | Peeters et al. | 347/21 |
| 6,340,216 | B1 | 1/2002 | Peeters et al. | 347/21 |
| 6,416,156 | B1 | 7/2002 | Noolandi et al. | 347/21 |
| 6,416,157 | B1 | 7/2002 | Peeters et al. | 347/21 |
| 6,416,158 | B1 | 7/2002 | Floyd et al. | 347/21 |

(Continued)

FOREIGN PATENT DOCUMENTS

DE 1 917 247 10/1970

(Continued)

*Primary Examiner* — Bryon Gehman
*Assistant Examiner* — Shawn Braden
(74) *Attorney, Agent, or Firm* — Morgan, Lewis & Bockius LLP

(57) ABSTRACT

In a gas cartridge, inside of a metal made outer can 1 is arranged with a metal made inner bag 2 charged with a fuel gas G1. A space between the outer can 1 and the inner bag 2 is charged with a compression gas G2 for pressing to crush the inner bag 2 in accordance with consumption of the fuel gas G1. Pertinent positions on an inner side of the outer can 1 are provided with deformation introducing members P1 through P7 for producing an initial deformation for introducing a deformation of the inner bag when a press force of the compression gas G2 is received.

9 Claims, 17 Drawing Sheets

U.S. PATENT DOCUMENTS

| | | | | |
|---|---|---|---|---|
| 6,416,159 | B1 | 7/2002 | Floyd et al. | 347/21 |
| 6,454,384 | B1 | 9/2002 | Peeters et al. | 347/21 |
| 6,454,834 | B1 | 9/2002 | Livingstone et al. | 95/11 |
| 6,467,862 | B1 | 10/2002 | Peeters et al. | 347/7 |
| 7,090,260 | B2 | 8/2006 | Revol | 285/369 |
| 2004/0000562 | A1 | 1/2004 | Gantner | 222/95 |

FOREIGN PATENT DOCUMENTS

| | | |
|---|---|---|
| DE | 202 00 906 | 7/2002 |
| EA | 2316132 | 1/1977 |
| EP | 1303048 | 9/1962 |
| EP | 1428355 | 5/1966 |
| EP | 1072404 | 6/1967 |
| EP | 1900704 | 8/1970 |
| EP | 2259754 | 8/1975 |
| EP | 2820127 | 8/2002 |
| JP | A-49-03213 | 1/1974 |
| JP | A-55-048068 | 4/1980 |
| JP | B-55-026073 | 7/1980 |
| JP | 57-178676 | 11/1982 |
| JP | U-59-131267 | 9/1984 |
| JP | U-60-018927 | 2/1985 |
| JP | U-60-148281 | 10/1985 |
| JP | U-60-169163 | 11/1985 |
| JP | A-61-246051 | 11/1986 |
| JP | 05-077844 | 3/1993 |
| JP | 6-5618 | 1/1994 |
| JP | B2-2873691 | 1/1999 |
| JP | 2004-44804 | 2/2004 |
| JP | 2004-263285 | 9/2004 |
| JP | A-2005-263285 | 9/2005 |
| TW | 183169 | 5/1992 |
| TW | 359476 | 5/1999 |
| TW | 415280 | 12/2000 |
| TW | 458895 | 10/2001 |
| TW | 491728 | 6/2002 |
| TW | 543513 | 7/2003 |
| TW | 1232916 | 5/2005 |

* cited by examiner

GAS CARTRIDGE

BACKGROUND OF THE INVENTION

1. Technical Field

The present invention relates to a gas cartridge for supplying a fuel gas used in a strike tool of a gas nailer or the like for striking a fastener of a nail, a screw or the like by a combustion pressure of the gas, or a gas cartridge for charging a cosmetic agent, an insect preventing agent, an insecticide or the like.

2. Background Art

A strike tool for striking a fastener of a nail, a screw or the like by a combustion pressure of a gas is charged with a gas cartridge and the gas is supplied from the gas cartridge. In a normal case, a gas cartridge is provided with a multiple structure comprising an outer vessel (outer can), a gas charge vessel (inner bag), and an inner space formed between the two vessels. A liquefied fuel gas at inside of the gas charge vessel is injected by compressing to deform the gas charge vessel by utilizing a pressure of a compression gas at high pressure charged into the inner space.

Further, the outer vessel and the gas charge vessel of the gas cartridge having the above-described two chamber structure pressure charging apparatus are made of aluminum, particularly, the gas charge vessel is easy to be deformed by receiving a press force of the compression gas, the gas at inside is not permeated to outside, and therefore, a comparatively thin vessel which is easily deformable is preferred (JP-B2-2873691).

Meanwhile, according to the vessels of the multiple structure of the gas cartridge, the fuel gas at inside of the gas charge vessel is discharged to outside of the gas cartridge by pressing to crush to thereby recess to deform the gas charge vessel by the pressure of the compression gas charged to the inner space between the two vessels. Deformation of the gas charge vessel utilizing the pressure of the gas is free deformation, and therefore, there is a case in which the gas charge vessel is not uniformly deformed. That is, at an initial stage of deforming the gas charge vessel, a portion having a weak rigidity is recessed to deform, deformation of the portion is further promoted, and therefore, in a number of cases, only one portion is considerably recessed to deform.

Further, since an opening portion and a bottom portion of the gas charge vessel are highly rigid and difficult to be deformed, and therefore, a stress is concentrated on a portion excluding these portions, further, deformation is continuously progressed from an initially deformed portion which is deformed initially, and therefore, only one portion is considerably deformed. Therefore, there is a case in which a wrinkle or a fold is brought about at the portion, and a crack or a pin hole is produced. For example, as shown by FIG. 22, a bottom portion 12 of an inner bag 2 is pulled to an opening side, a stress is liable to be concentrated on a boundary portion 13 between the bottom portion 12 and a side face portion 10, and therefore, there is brought about a phenomenon that the bottom portion 12 is considerably deformed to fall down to the opening side. When a crack or a pin hole is produced at the gas charge vessel in accordance therewith, the compression gas is brought into the inner bag charged with a gas, and therefore, the pressure of the compression gas is relatively reduced and a gas charge vessel is not sufficiently compressed. Therefore, the fuel gas is discharged insufficiently, and a function thereof as a gas can is lost while the fuel gas remains. Abandoning the fuel gas before being sufficiently utilized not only deteriorates an operational efficiency of the strike tool constituting a drive source by the gas but also constitutes an economic loss.

In this way, according to the gas cartridge, both of the outer can and the inner bag are made of a metal, particularly, the inner bag is thin-walled, and therefore, there poses a particular problem that a crack or a pin hole is liable to be produced.

SUMMARY OF THE INVENTION

One or more embodiments of the invention provide a gas cartridge in which a deformation of recessing an inner bag is made not to be deviated by preventing a stress from being concentrated only on a portion of the inner bag by a compression gas to thereby enable to effectively prevent a crack or a pin hole from being produced at the inner bag by improving the gas cartridge by particularly placing a view point to improving the inner bag.

According to a first aspect of the invention, a gas cartridge arranged with a metal made inner bag charged with a gas at inside of a metal made outer can and charged with a compression gas for pressing to crush the inner bag in accordance with consumption of the fuel gas at a space between the outer can and the inner bag includes a deformation introducing member for producing an initial deformation for introducing a deformation of the inner bag when a press force of the compression gas is received at a pertinent position on an inner side of the outer can.

Further, according to a second aspect of the invention, in the gas cartridge according to the first aspect, the deformation introducing member may be provided at inside of the inner bag and may produce the initial deformation at the inner bag by receiving the press force of the compression gas.

Further, according to a third aspect of the invention, in the gas cartridge according to the first aspect, the deformation introducing member may be provided at outside of the inner bag, and may produce the initial deformation at the inner bag by receiving a gas pressure of the charged gas.

Further, according to a fourth aspect of the invention, in the gas cartridge according to the first aspect, the deformation introducing members may be provided at inside and outside of the inner bag, and may produce the initial deformation at the inner bag by receiving the press force of the compression gas and the gas pressure of the charged gas.

Further, according to a fifth aspect of the invention, in the gas cartridge according to the third aspect, the deformation introducing member may include a deformation introducing portion in a frame-like shape provided at the space between the inner bag and the outer can.

Further, according to a sixth aspect of the invention, in the gas cartridge according to the fifth aspect, an outer diameter of the inner bag including the deformation introducing member may be larger than an inner diameter of the outer can.

According to the first aspect of the gas cartridge, the deformation introducing member for producing the initial deformation of the inner bag is provided, and therefore, when the inner bag is pressed to crush to deform by the compression gas in accordance with consumption of the gas at inside of the inner bag, the initial deformation which is deformed initially urges successive deformation. Therefore, the deformation is progressed successively from the initially deformed portion. In this way, the deformation can intentionally be introduced, and the deformation by the compression gas can be dispersed to a plurality of portions so as not to be deviated to a portion on which a stress is concentrated. Further, since the initial deformation is determined by the deformation introducing member, there is a low possibility of initially deforming a portion which is physically inferior in a rigidity thereof the most. Therefore, a crack or a pin hole by a wrinkle or a fold can effectively be prevented.

Further, according to the second aspect of the gas cartridge, the deformation introducing member is provided at inside of the inner bag, and therefore, although the deformation introducing member is not deformed when the fuel gas is charged to the inner bag, when the compression gas is charged to the space between the outer can and the inner bag, the initial deformation is produced at the inner bag by receiving the press force of the compression gas. Therefore, the deformation can be introduced to progress from the initially deformed portion.

Further, according to the third aspect of the gas cartridge, the deformation introducing member is provided at outside of the inner bag, and therefore, the initial deformation is produced by the deformation introducing member when the inner bag is bulged by receiving the gas pressure in charging the gas to the inner bag. Therefore, the deformation can be introduced to progress from the initially deformed portion.

Further, according to the fourth aspect of the gas cartridge, the deformation introducing members are provided at inside and outside of the inner bag, and therefore, although the deformation introducing member is not deformed when the gas is charged to the inner bag, the initial deformation is produced at the inner bag by the deformation introducing members by receiving the press force of the compression gas when the compression gas is charged to the space between the outer can and the inner bag and receiving the gas pressure when the gas is charged to the inner bag. Therefore, the deformation can be introduced to progress from the initially deformed portion.

Further, according to the fifth aspect of the gas cartridge, the deformation introducing portion formed at the deformation introducing member is formed in the frame-like shape at the space between the inner bag and the outer can, and therefore, when the compression gas is charged to the outer can, the deformation can easily be formed at the surface of the inner bag by the deformation introducing member. Therefore, also in this case, the inner bag is pressed to crush to deform by the compression gas in accordance with consumption of the gas at inside of the inner bag, since the deformation is progressed precedingly from the initially deformed portion, the deformation by the compression gas is not deviated to a portion on which a stress is concentrated but dispersed to a plurality of portions.

Further, according to the sixth aspect of the gas cartridge, the outer diameter of the inner bag including the deformation introducing portion is made to be larger than the inner diameter of the outer can, and therefore, when the inner bag and the deformation introducing portion are forcibly pressed to inside of the outer can, the deformation introducing portion is pressed to the outer face of the inner bag, and the outer face of the inner bag can be produced with the initial deformation in accordance with the shape of the deformation introducing portion.

Other aspects and advantages of the invention will be apparent from the following description and the appended claims.

DESCRIPTION OF REFERENCE NUMERALS AND SIGNS

Figure 1:
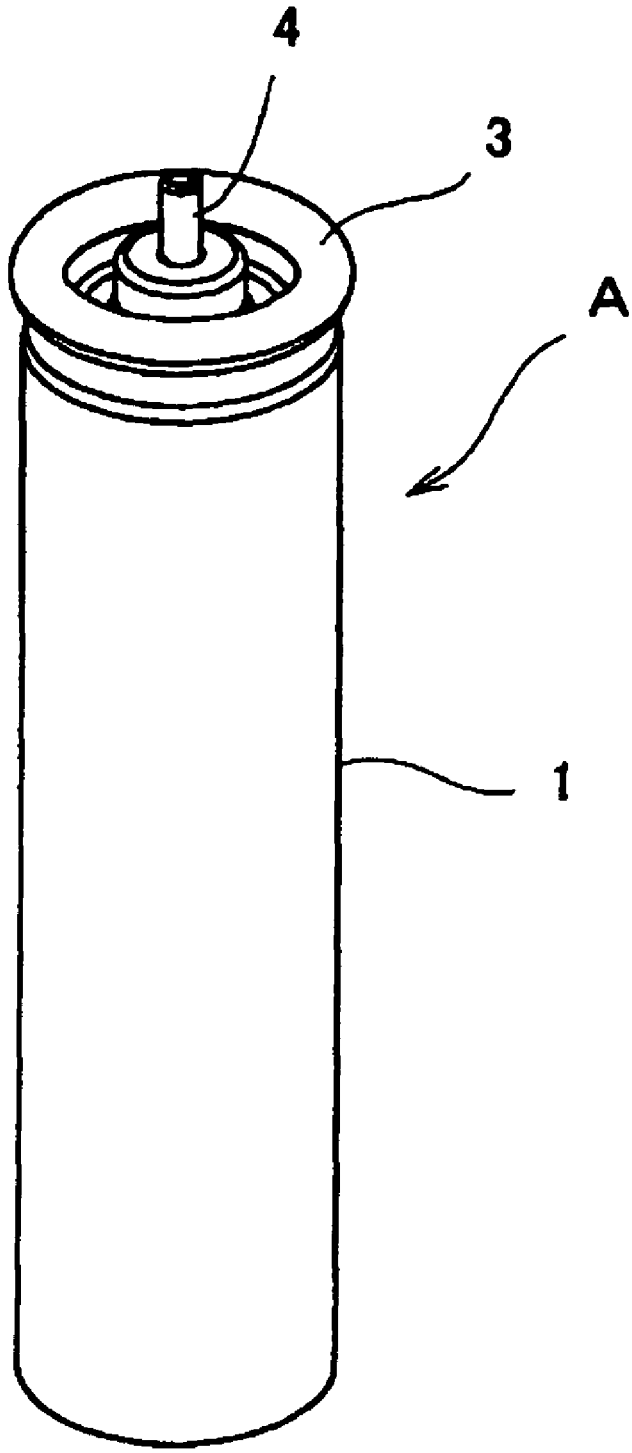
FIG. 1 is a perspective view of a gas cartridge according to a first exemplary embodiment of the invention.

1 . . . outer can
2 . . . inner bag
P1 through P7 . . . deformation introducing members

DETAILED DESCRIPTION OF THE EXEMPLARY EMBODIMENTS

Exemplary embodiments of the invention will be explained in reference to the drawings as follows.

Further, a deformation introducing member may directly introduce to deform the inner bag or may indirectly introduce to deform the inner bag so far as the deformation introducing member introduces to deform the inner bag when compressed by a compression gas in accordance with consumption of the gas at inside of the inner bag and is not limited to embodiments described below.

Further, although a gas charged to the inner bag is normally a liquefied gas, the gas is not necessarily limited to the liquefied gas.

First Exemplary Embodiment

A gas cartridge according to a first exemplary embodiment of the invention will be explained in reference to FIG. 1 through FIG. 7. The gas cartridge is constituted by a mode in which a deformation introducing member is made of a synthetic resin and provided at inside of an inner bag.

That is, as can be understood from FIG. 1 through FIG. 4, the gas cartridge A is constituted by an outer can 1, an inner bag 2 arranged at inside of the outer can 1, a cap valve member 3 for injecting a gas charged into the inner bag 2 and the like. Inside of the inner bag 2 is charged with a fuel gas G1, and a compression gas G2 at a pressure higher than a pressure of the fuel gas G1 is charged to spaces S1, S2 between bottom portions of the outer can 1 and the inner bag 2 and between side face portions thereof. The compression gas G2 is for injecting the fuel gas G1 from an injection pipe 4 of the cap valve member 3 to outside by pressing to crush the inner bag 2 by pressing a surface of the inner bag 2, and a gas of propane, propylene, butane or the like is normally used therefor.

Figure 3:
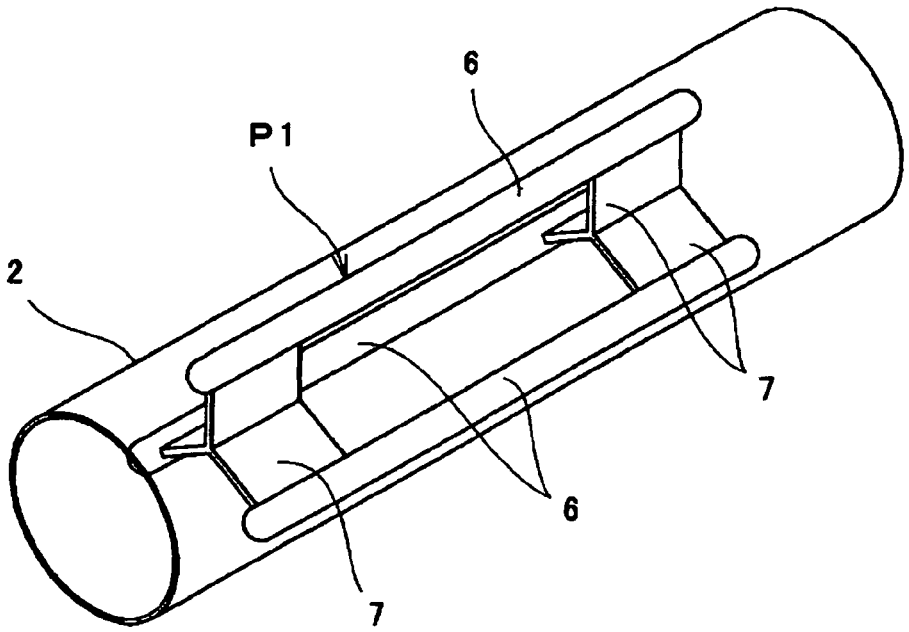
FIG. 3 is a perspective view of an inner bag in a state of containing a parallel frame as a deformation preventing portion.
Figure 4:
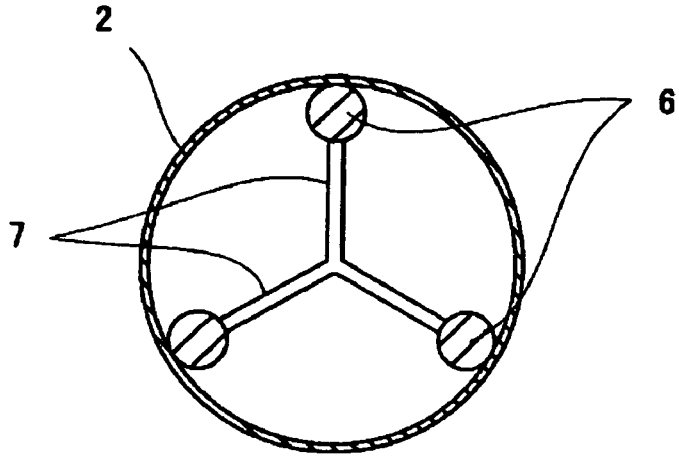
FIG. 4 is a center cross-sectional view of FIG. 3.

As shown by FIG. 3, the outer can 1 comprises a cylindrical member made of aluminum having a predetermined diameter and a predetermined length and a predetermined wall thickness, one end thereof is opened and other end thereof is closed. In contrast thereto, since the inner bag 2 is arranged at inside of the outer can 1, the inner bag 2 comprises a thin bottomed cylindrical member made of aluminum which is provided with an outer shape similar to that of the outer can 1, smaller than the outer can and easy to deform in a state in which the gas is not charged to inside thereof yet.

Figure 5:
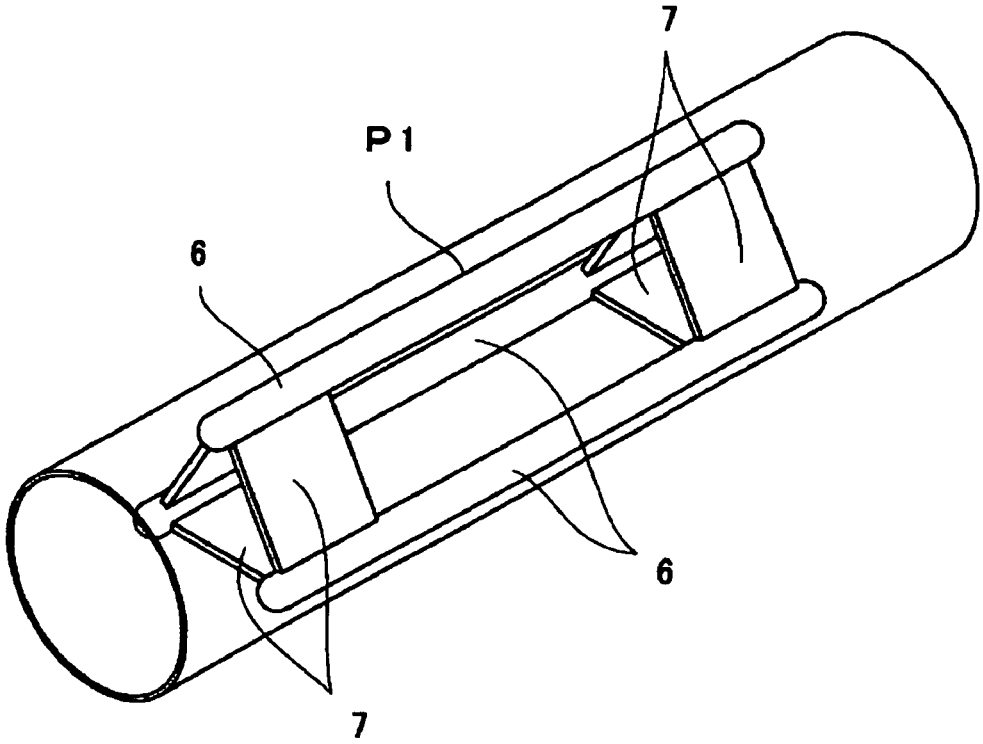
FIG. 5 is a perspective view of an inner bag containing a parallel frame of a modified example of the first exemplary embodiment.

Next, inside of the inner bag 2 is provided with a parallel frame P1 as a deformation introducing member for preventing a portion of the inner bag 2 from being deformed and urging to deform other portion thereof when a press force of the compression gas is received. The parallel frame P1 is made of a synthetic resin, constituted by connecting 3 pieces of the frame portions 6 by connecting portions 7, and the connecting portion 7 may be constituted by a mode of being extended radially from a center portion disposed at equal distances from the frame portions 6, or may be constituted by a mode of directly connecting the frame portions 6 as shown by FIG. 5.

Further, it is preferable that the connecting portions 7 are disposed only at both ends thereof and a portion thereof excluding the both ends lack the connecting portion 7. Further, it is preferable that a length of the parallel frame P1 is constituted by a length of a half or more of the inner bag 2. Further, the connecting portion 7 between the frame portion 6 may not be at equal lengths. That is, in FIG. 3, it is not necessary that an angle between the connecting portions 7 contiguous to each other is 120 degrees. In FIG. 5, it is not necessary that a triangle connecting the connecting portion 7 is constituted by a regular triangle. Further, other polygonal shape will do, the frame portions may be constituted by a plurality of pieces thereof and are not limited to 3 pieces thereof.

The inner bag 2 provided with the parallel frame P1 at inside thereof is inserted into the outer can 1. Further, opening edges of the outer can 1 of the inner bag 2 are bonded integrally with each other by being seamed to a peripheral edge portion 3*a* of the cap valve member 3. Further, the side portion space S2 is formed between an outer peripheral face of the inner bag 2 and the inner peripheral face of the outer can 1 in a state in which the gas is not charged yet. At the same time, the bottom portion space S1 is continuously formed between the bottom portion of the outer can 1 and the bottom portion of the inner bag 2.

Inside of the inner bag 2 is charged with the fuel gas G1 from the injection pipe 4 of the cap valve member 3, and the inner spaces S1, S2 of the outer can 1 of the vessel are charged with the compression gas G2 for pressing to crush the inner bag 2 for injecting the gas. The bottom portion of the outer can 1 is formed with a cap 8 for charging the compression gas, the compression gas G2 is charged therefrom, and the cap 8 is sealed by a plug 9.

Figure 2:
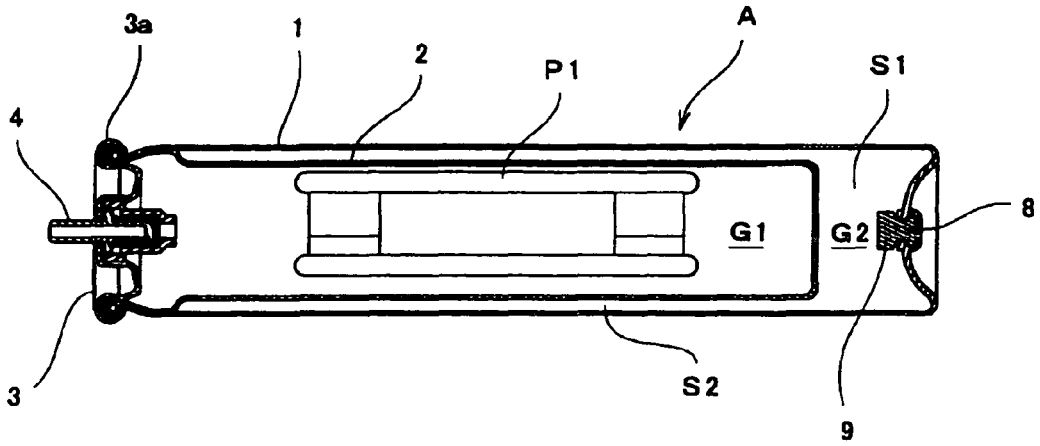
FIG. 2 is a vertical sectional view of the gas cartridge.

Thereby, as shown by FIG. 1, FIG. 2, there is formed the gas cartridge A of a double structure of a concentrical arrangement mainly constituted by the outer can 1 and the inner bag 2 and including the cap valve member 3.

When the gas cartridge A having the above-described constitution is used by being charged to a strike tool of a gas nailer or the like, the valve member 5 is opened by pressing the injection pipe 4 against a force of a spring 6, thereby, the gas at inside of the inner bag 2 is injected to outside. Further, in accordance with discharging the gas at inside of the inner bag 2, the inner bag 2 is going to be pressed to crush by the compression gas G2 at inside of the outer can 1. Therefore, the pressure at inside of the inner bag 2 is not reduced, and therefore, the fuel gas G1 is continuously injected. In accordance with consumption of the liquefied fuel gas at inside of the inner bag 2, the inner bag 2 is pressed to crush to deform by the compression gas, and is deformed precedingly from the side face portion having a low rigidity.

Figure 6:
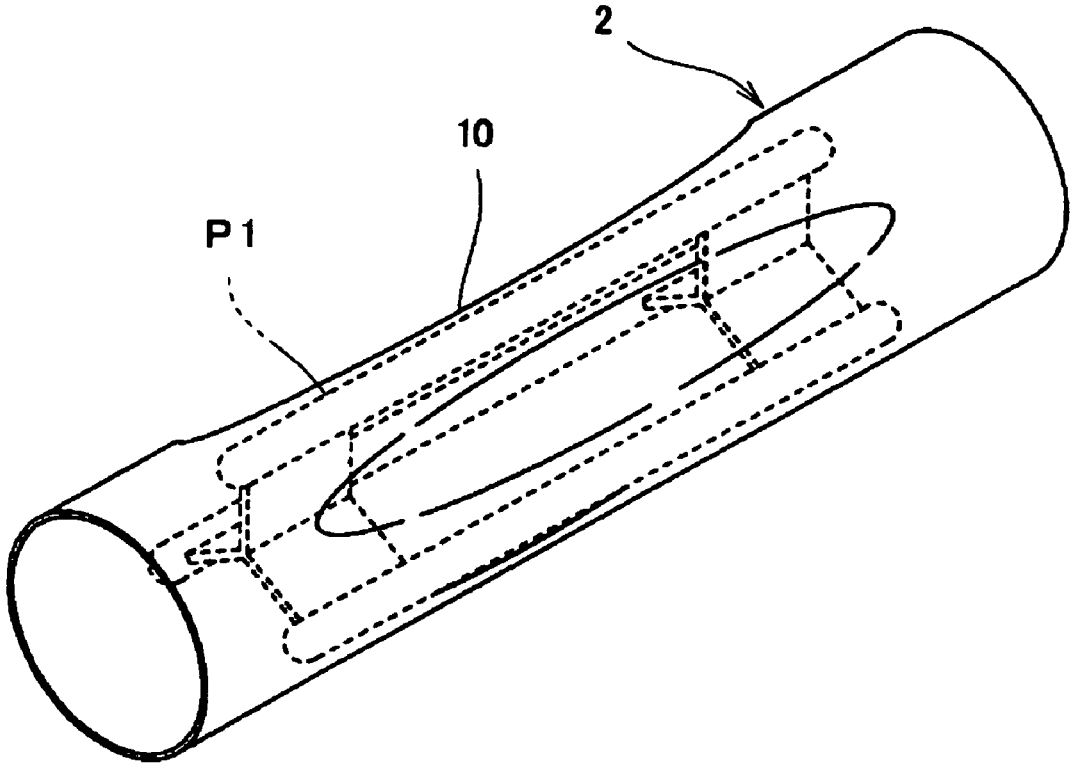
FIG. 6 is a perspective view showing a state in the midst of deforming the inner bag.

However, since the inner bag 2 is provided with the parallel frame P1, as shown by FIG. 6, when the press force of the compression gas G2 is received, only a side face portion 10 excluding the frame portion 6 of the parallel frame P1 is initially recessed to deform and the deformation is introduced to progress from the portion. However, the deformation is not concentrated on one portion but is dispersed also to other portion, further, the frame portion 6 constitutes a resistance against deformation, and therefore, only one portion cannot considerably deformed. Further, the initial deformation is determined by the frame portion 6, and therefore, there is a low possibility of initially deforming a portion which is physically inferior in a rigidity thereof the most. Therefore, a crack or a pin hole by a wrinkle or a fold can effectively be prevented from being brought about.

Further, since the parallel frame P1 is constituted by a synthetic resin, in accordance with consumption of the fuel gas G1 at inside, the connecting portion 7 is going to be deformed by the press force of the compression gas G2, finally, a total of the inner bag 2 is crushed and almost all of the fuel gas G1 at inside can be discharged.

Figure 22:
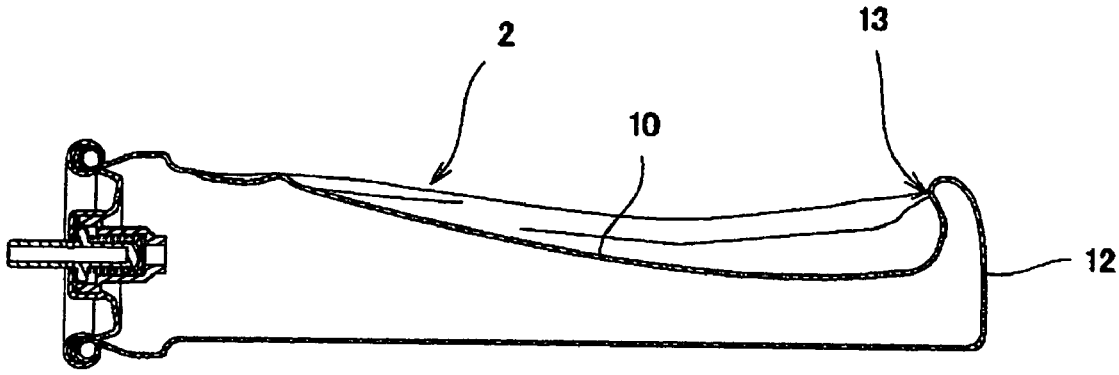
FIG. 22 is a vertical sectional view showing an example of deforming an inner bag of a background art.

In contrast thereto, in the case of the gas cartridge of the background art, as described in reference to FIG. 22, deformation by being pressed is deviated to a portion having a comparatively small rigidity, only the portion is considerably deformed, and therefore, a crack or a pin hole is easy to be produced. Particularly, the bottom portion 12 is pulled to the opening side, a stress is liable to be concentrated on the boundary portion 13 between the bottom portion 12 and the side face portion 10, and therefore, there is brought about the phenomenon in which the bottom portion 12 is deformed considerably to fall down to the opening side.

Figure 7A:
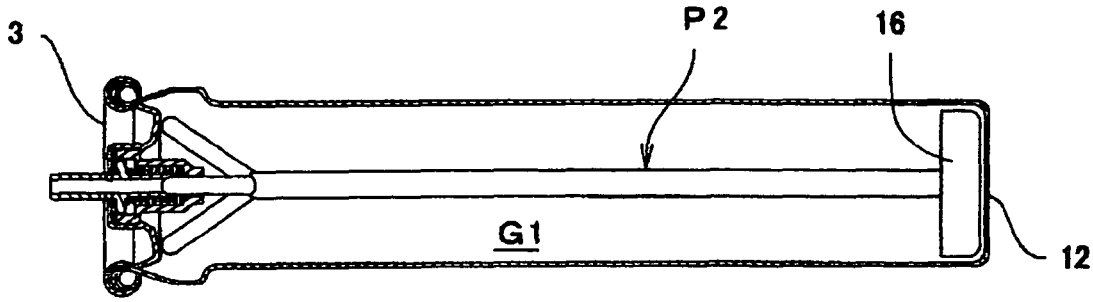
FIG. 7A is a vertical sectional view of an inner bag containing a cored deformation preventing plate as a deformation introducing member showing other modified example of the first exemplary embodiment.
Figure 7B:
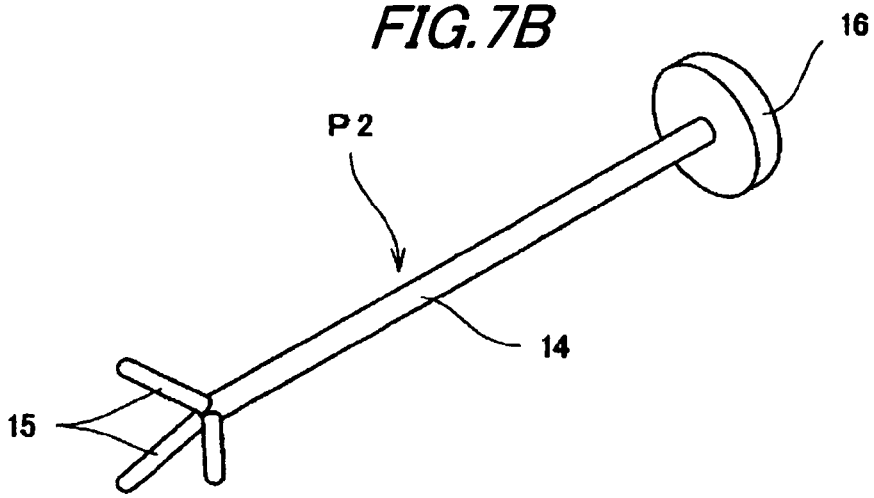
FIG. 7B is a perspective view of the cored deformation preventing plate of FIG. 7A.

Further, as shown by FIG. 7A and FIG. 7B, the deformation introducing member provided at inside of the inner bag 2 may be constituted as a cored deformation preventing plate P2. That is, the deformation preventing plate P2 is projected to form with a plurality of pieces (3 pieces in this case) of branch portion 15 in a skewed radial shape at one end of a core member 14 at a center and extended to form with a circular plate member 16 to an outer side at other end thereof, the branch portion 15 is engaged with a back face of the cap valve member 3, and the circular plate member 16 is brought into contact with the inner face of the bottom portion 12.

Figure 7C:
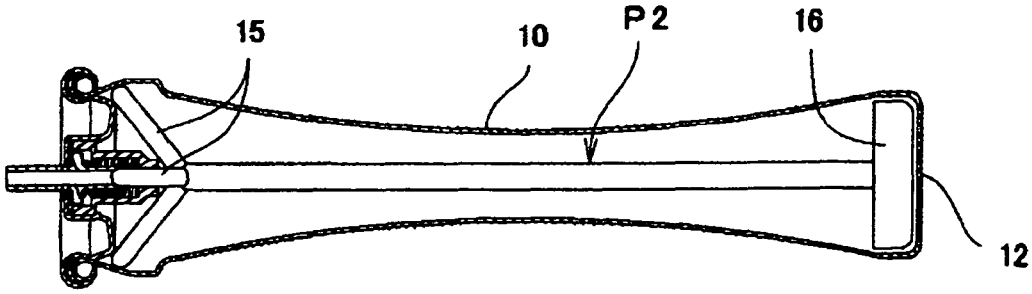
FIG. 7C is a perspective view of the inner bag in the midst of deforming the inner bag in the embodiment of FIG. 7A.

According to the above-described constitution, the core member 14 and the branch member 15 stretch each other, and therefore, when in accordance with consumption of the fuel gas G1 at inside of the inner bag 2, the inner bag 2 is pressed to crush to deform by the compression gas G2, as shown by FIG. 7C, the inner bag 2 is going to be recessed to deform to the inner side from the side face portion 10. Further, since the bottom portion 12 is supported by the circular plate member, the bottom portion 12 is difficult to be deformed. Therefore, the bottom portion 12 is not pulled to fall down to the opening side, and therefore, the deformation as shown by FIG. 22 is prevented, and a crack or a pin hole by a wrinkle or a fold can effectively be prevented from being brought about.

The deformation preventing plate P2 is also constituted by a synthetic resin, and therefore, in accordance with consumption of the fuel gas G1 at inside, the branch portion is deformed by the press force of the compression gas G2 and finally, a total of the inner bag 2 is crushed and almost all of the gas at inside is discharged.

Second Exemplary Embodiment

A gas cartridge according to a second exemplary embodiment of the invention will be explained as follows in reference to FIG. 8 through FIG. 11. Here, there is shown a gas cartridge of a mode in which a deformation introducing member comprising synthetic resin, rubber, paper or the like is provided at outside of the inner bag 2.

Figure 8:
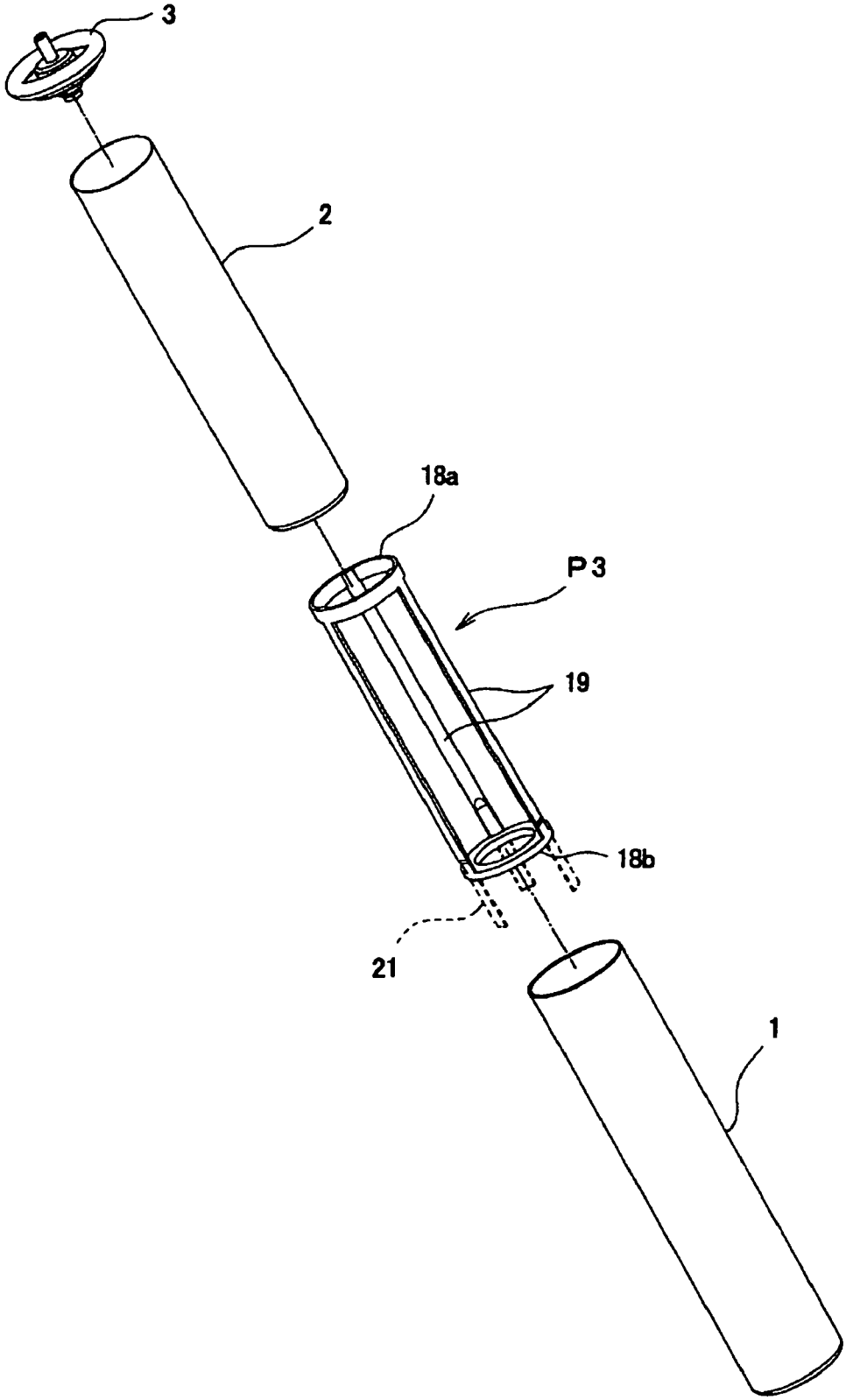
FIG. 8 is a disassembled perspective view when a surrounding frame is constituted as a deformation introducing member showing a second exemplary embodiment of the invention.

That is, as shown by FIG. 8 and FIG. 9, the outer peripheral face of the inner bag 2 is arranged with a surrounding frame P3 as a deformation introducing member. The surrounding frame P3 is made of a synthetic resin and connected with ring portions 18*a*, 18*b* at both ends thereof by way of 3 pieces of frame-like portions 19 (not limited to 3 pieces) arranged at equal intervals. An inner side section of the frame-like portion 19 is formed in a circular arc shape. Further, the ring portion 18*a* on one side and a portion 8 of the frame-like portion 19 proximate to an end portion on other side are formed to be thin-walled to facilitate to insert the bottom portion of the inner bag 2 to inside of the outer can 1. Further, outer diameters of the ring portions 18*a*, 18*b* are formed to be substantially the same as the inner diameter of the outer can 1, and the frame-like member 19 is formed to be slightly shorter than the inner bag 2. The ring portion 18*b* on the bottom portion side is formed to receive the bottom portion 12.

Figure 9A:
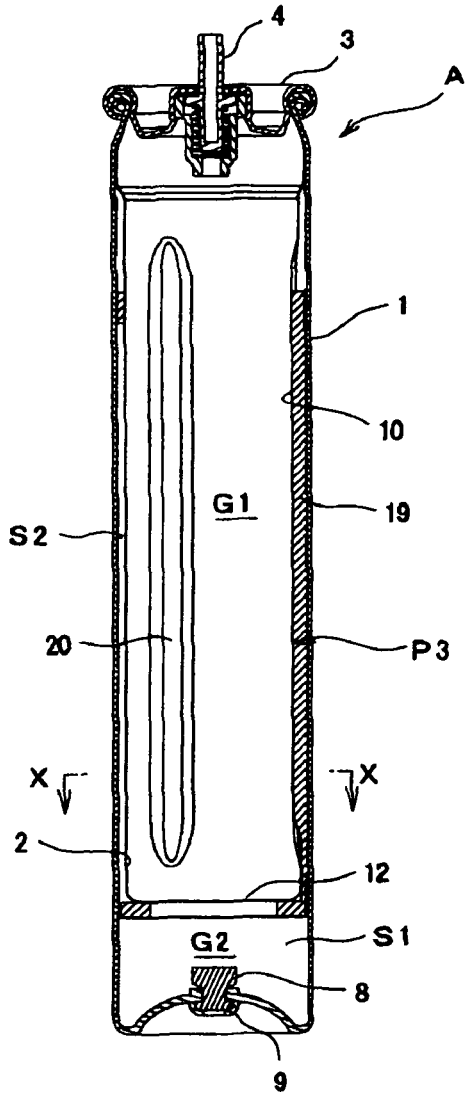
FIG. 9A is a vertical sectional view of a state of using the surrounding frame of FIG. 8.
Figure 9B:
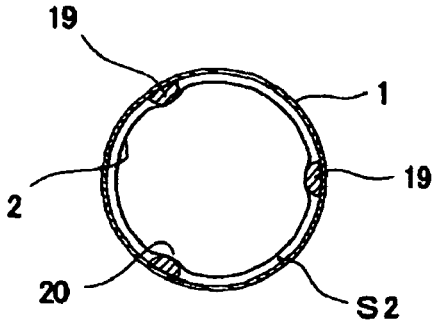
FIG. 9B is a cross-sectional view of the state of using the surrounding frame of FIG. 8.

When the inner bag 2 is inserted into the outer can 1, the inner bag 2 is inserted to inside of the outer can 1 to surround a surrounding of the inner bag 2 by the frame-like member 19. Thereby, the surrounding of the inner bag 2 is surrounded by the surrounding frame P3, as shown by FIG. 9A and FIG. 9B, there is formed the gas cartridge A of the double structure by bonding the outer can 1 and the inner bag 2 integrally by way of the cap valve member 3 at the opening portion. At this occasion, a center portion of the outer peripheral face of the inner bag 2 is formed with 3 pieces of the deformed recessed portions 10 uniformly at intervals of 120 degrees in the peripheral direction.

Meanwhile, when the fuel gas G1 is charged into the inner bag 2, the thin inner bag 2 made of aluminum is bulged in accordance with an amount of charging the gas. When the fuel gas is sufficiently charged to inside of the inner bag 2, the inner peripheral face of the outer can 1 and the outer peripheral face of the inner bag 2 are brought into substantially a state of being brought into close contact with each other, the surrounding frame P3 is pressed to the outer peripheral face of the inner bag 2, and therefore, an outer surface thereof is plastically deformed to be directly formed with a recessed portion 20 constituting an initial deformation.

Figure 10A:
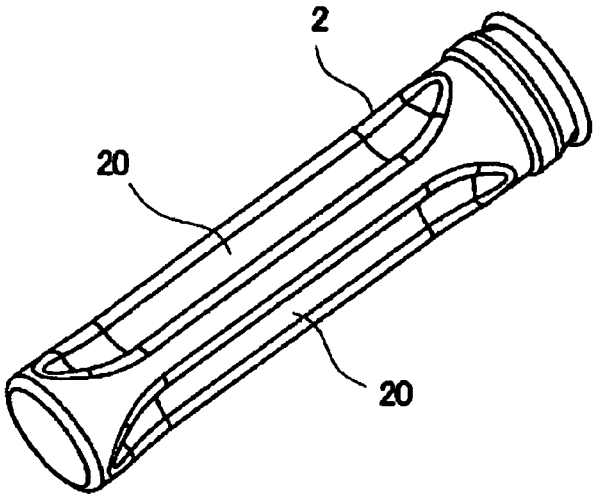
FIG. 10A is a perspective view showing a state in the midst of deforming the inner bag of FIG. 8.
Figure 10B:
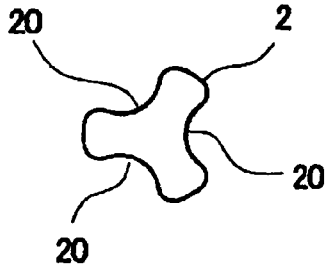
FIG. 10B is a center cross-sectional view showing the state in the midst of deforming the inner bag of FIG. 8.

According to the gas cartridge A having the above-described constitution, the gas cartridge A is charged to a strike tool of a gas nailer or the like, the inner bag 2 is pressed to crush to deform by the compression gas G2 in accordance with consumption of the fuel gas G1 at inside of the inner bag 2, as shown by FIG. 10A and FIG. 10B, the deformation is introduced such that the deformation is urged further from the recessed portion 20 initially deformed by the frame-like portion 19 to progress. Therefore, the deformation by pressing is not deviated to one portion but dispersed to three portions, and therefore, local stress concentration is avoided, and a crack or a pin hole by a wrinkle or a fold can effectively be prevented from being produced.

Further, in a state of charging the gas cartridge A to a strike tool of a gas nailer or the like, when the strike tool is violently vibrated in striking a nail or the like, the gas cartridge per se arranged at inside thereof is also vibrated. At this occasion, the opening portion of the inner bag 2 is integrally bonded with the outer can 1 by the cap valve member 3, the side portion space S2 is formed between the bottom portion 12 and the side portion of the outer can 1, and therefore, the bottom portion 12 of the inner bag 2 is violently vibrated in a front and rear direction and a left and right direction (outer direction). In this way, whereas the opening side is fixed, the side of the bottom portion 12 is violently vibrated to move, and therefore, when the vibration is repeated by a number of times, there is concern of destructing a vicinity of the opening portion of the inner bag 2 by a bonding stress thereof. However, since the surrounding frame P3 is arranged between the inner bag 2 and the outer can 1, the vibration of the bottom portion 12 of the inner bag 2 is restrained, deformation of the opening portion is excellently prevented, and the opening portion can effectively be prevented from being destructed.

Further, the surrounding frame P3 may be constituted by a simple cylindrical member, and therefore, the surrounding frame P3 can be fabricated at low cost.

Further, the surrounding frame P3 may be formed with a leg portion 21 indicated by a dotted line in FIG. 8. In this case, the surrounding frame P3 is positioned to a predetermined position by butting a front end of the leg portion 21 to the bottom portion of the outer can 1 when the inner bag 2 is arranged at inside of the outer can 1.

Figure 11A:
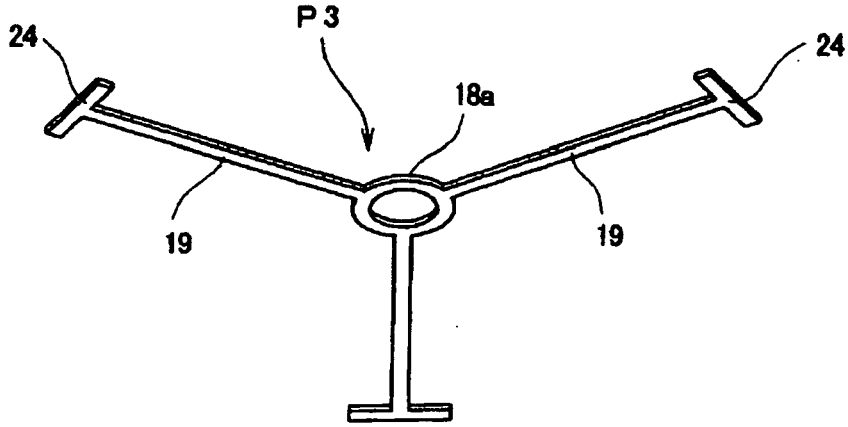
FIG. 11A is a perspective view of still other mode of the surrounding frame of the second exemplary embodiment.
Figure 11B:
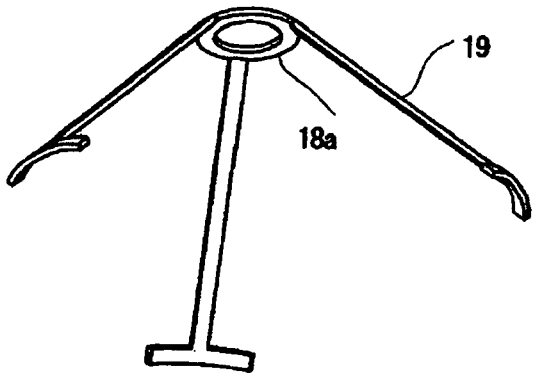
FIG. 11B shows a state of deforming the surrounding frame of FIG. 11A for mounting the surrounding frame to the inner bag.
Figure 11C:
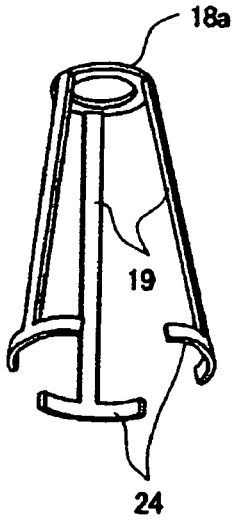
FIG. 11C shows a state of further deforming the surrounding frame of FIG. 11A for mounting the surrounding frame to the inner bag.

Further, as shown by FIG. 11A through FIG. 11C, the surrounding frame P3 may be constructed by a constitution of extending 3 pieces of the frame-like portions 19 radially from the ring portion 18*a* on one side and forming ring pieces 24 constituted by dividing the ring portion on other side by 3 orthogonally to front ends of the respective frame-like portions 19.

Figure 12:
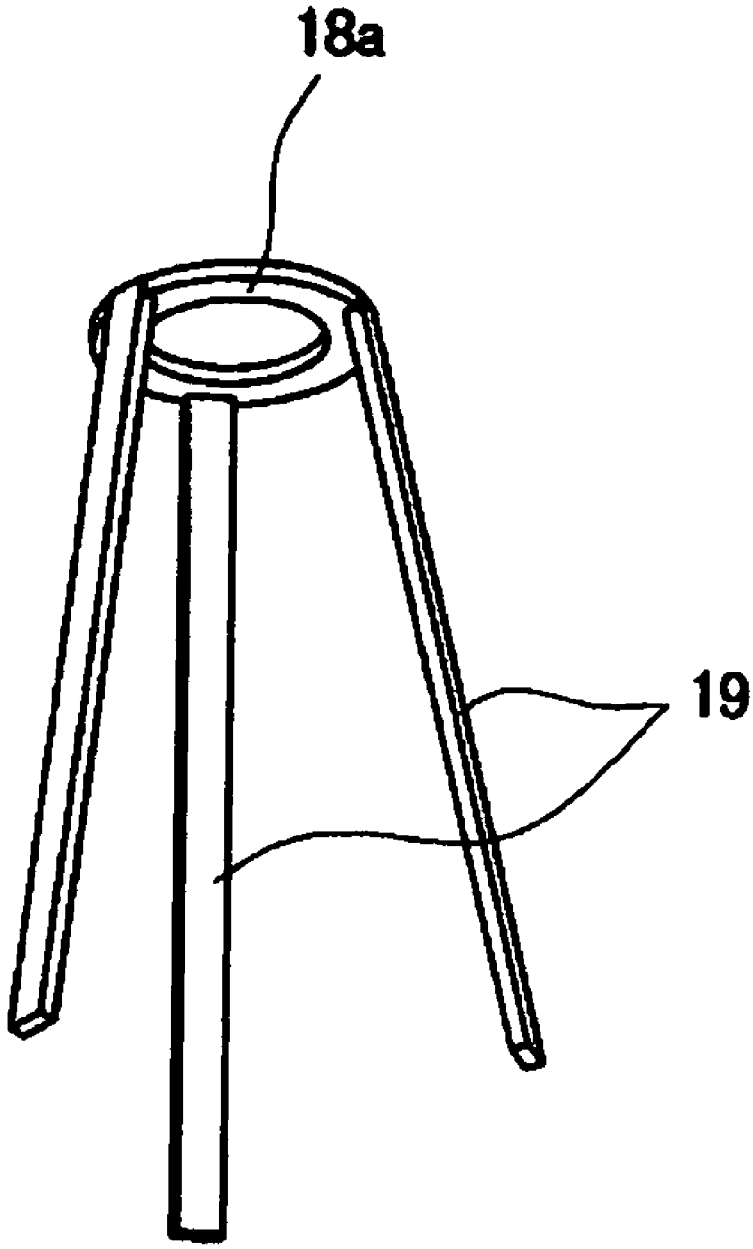
FIG. 12 is a perspective view of other mode of the surrounding frame of the second exemplary embodiment.
Figure 13:
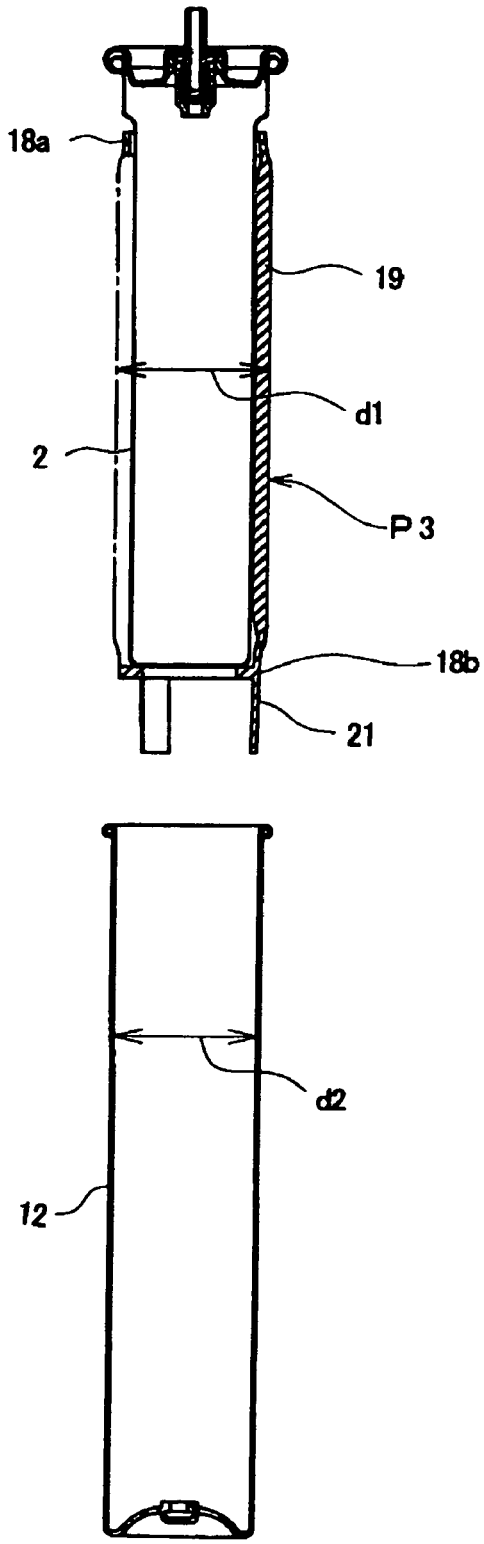
FIG. 13 is a disassembled view of a gas cartridge shown along with still other mode of the surrounding frame of the second exemplary embodiment.
Figure 14:
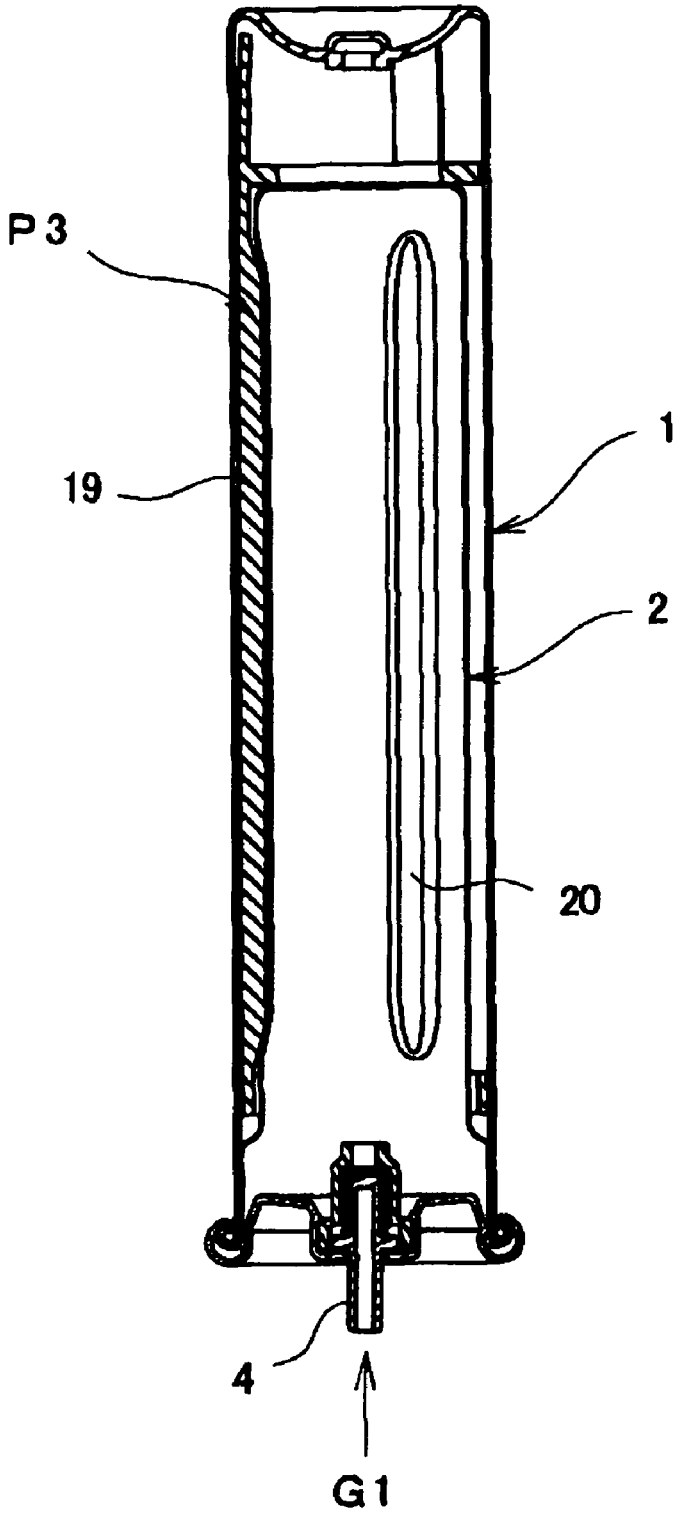
FIG. 14 is a vertical sectional view of the gas cartridge.

Further, as shown by FIG. 12, there may be constructed a constitution of only extending 3 pieces of the frame-like portions 19 radially from the ring portion 18*a* on one side.

Furthermore, although not illustrated, there may be constructed a constitution of integrally adhering the frame-like portion 19 to the outer peripheral face of the inner bag 2.

Next, an explanation will be given of other means of forming the recessed portion 20 at the outer peripheral face of the inner bag 2 by the surrounding frame P3 in reference to FIG. 13 through FIG. 16.

That is, the surrounding frame P3 is made of a synthetic resin and is connected with 3 pieces of the frame-like portions 19 (not limited to 3 pieces) by way of the ring portion. Numeral 21 designates a leg portion. An outer diameter d1 (refer to FIG. 13, FIG. 15A) of the inner bag 2 including the frame-like member is formed to be larger than an inner diameter d2 of the outer can 1. However, an outer diameter of the ring portion 18*b* is formed to be substantially the same as the inner diameter d2 of the outer can 1, and the surrounding frame P3 is slightly shorter than the inner bag 2.

Figure 15A:
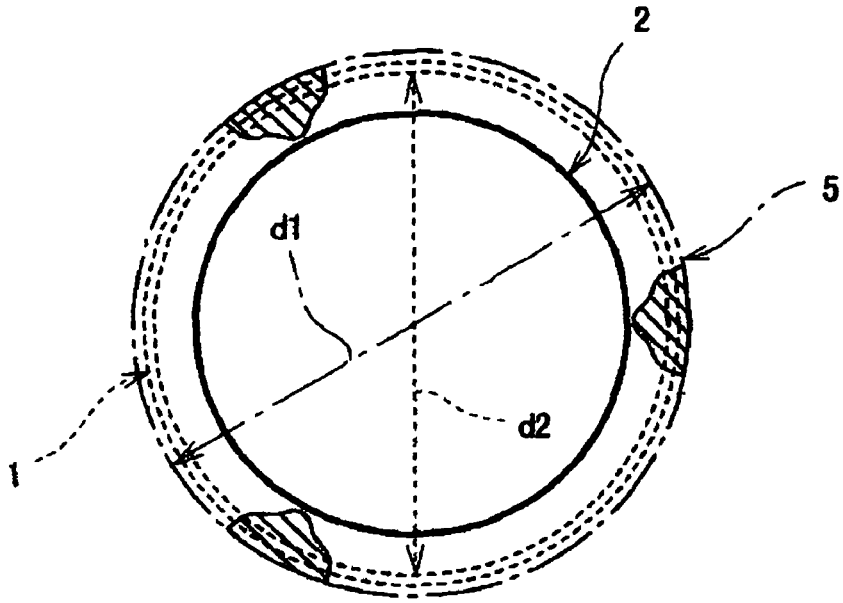
FIG. 15A is a sectional view showing the inner bag and a deformation introducing portion before being pressed of the gas cartridge of FIG. 13.
Figure 15B:
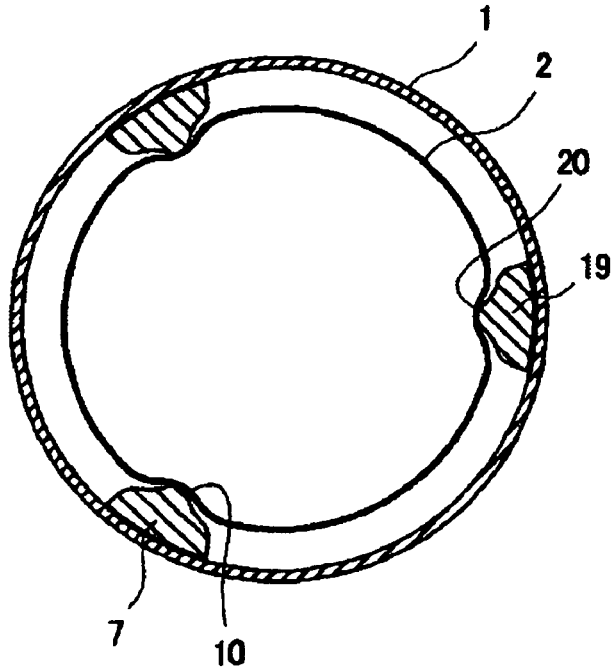
FIG. 15B is a sectional view showing a state of the inner bag and the deformation introducing portion and an outer can after having been pressed of the gas cartridge of FIG. 13.
Figure 15C:
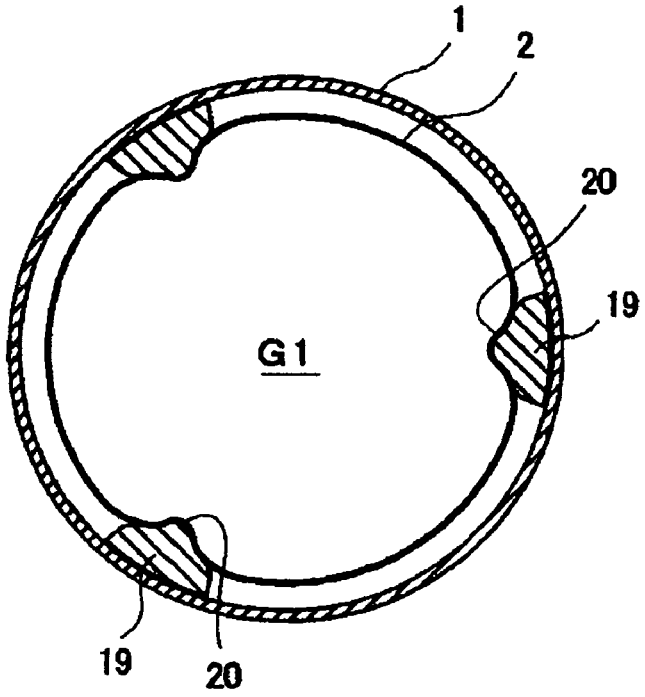
FIG. 15C is a sectional view showing a state of the inner bag and the deformation introducing portion and the outer can after having been pressed of the gas cartridge of FIG. 13.

Further, in integrating the gas cartridge, when the inner bag 2 is forcibly pressed to inside of the outer can in a state of arranging the surrounding frame P3 along a longitudinal direction at an outer side of the inner bag 2, the frame-like portion 19 brought into a state shown in FIG. 15A before being pressed is pressed to the outer face of the inner bag 2 shown by FIG. 15B, and therefore, the outer face of the inner bag 2 is formed with the recessed portion 20 in accordance with the shape of the deformation introducing portion by the frame-like portion 19. Further, as shown by FIG. 15C, the recessed portion 20 is further enlarged by charging the fuel gas G1 into the inner bag 2. Therefore, the outer face of the inner bag 2 can firmly be formed with the recessed portion 20 constituting the initial deformation.

Therefore, when the inner bag is pressed to crush to deform by the compression gas in accordance with consumption of the gas at inside of the inner bag 2 in being used, the recessed portion 20 urges to further deform the inner bag 2, the deformation is progressed further from the recessed portions 20, and therefore, the deformation by the compression gas is further effectively dispersed, a crack or a pin hole can further effectively be prevented from being brought about.

Figure 16:
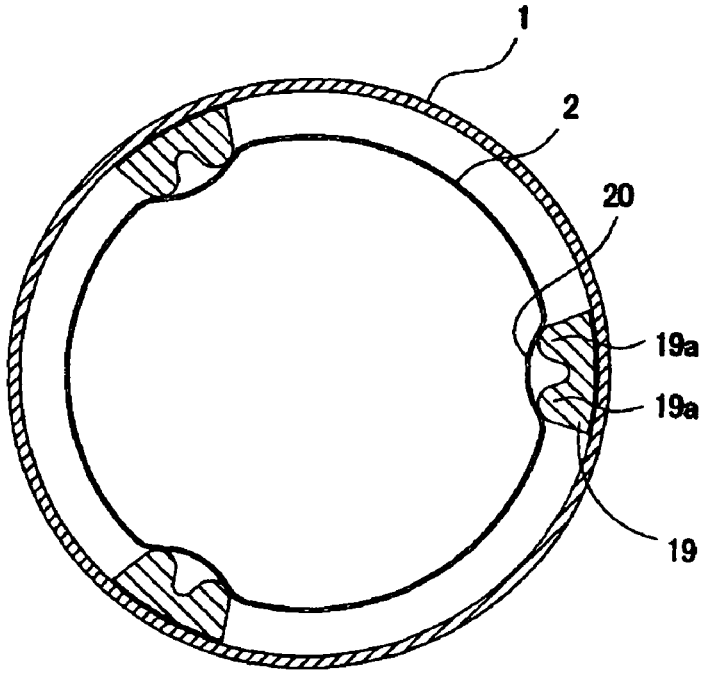
FIG. 16 is a sectional view of other mode of the deformation introducing member of the second exemplary embodiment.

Further, as shown by FIG. 16, a sectional shape of the frame-like portion 19 constituting a deformation introducing portion may be constituted by a shape in which two of frame-like portions 19*a*, 19*a* are continuous in a transverse direction on an inner side of the surrounding frame 3.

Figure 17:
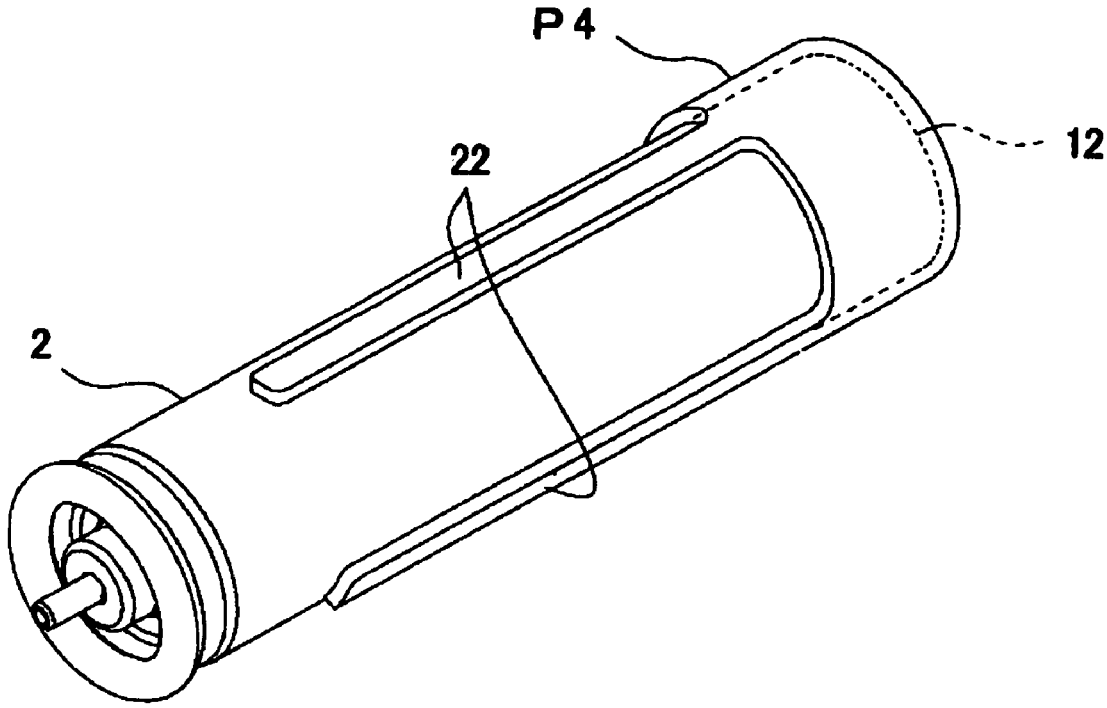
FIG. 17 is a perspective view of an example of constituting a deformation introducing portion by a cap.

Further, a mode of a deformation introducing member provided at the outside of the inner bag 2 may be constructed by a constitution of setting a cap P4 having a frame-like portion 22 at the bottom portion 12 of the inner bag 2 as shown by FIG. 17. A bottom portion of the cap P4 may be formed by a doughnut-like shape.

According to the above-described constitution, when the fuel gas G1 is charged into the inner bag 2 and the compression gas G2 is charged to the outer can 1, the outer peripheral face of the inner bag 2 is formed with a recess by being pressed by the frame-like portion 22, and therefore, similar to the case of FIG. 9B, the deformation is introduced such that the deformation is naturally urged precedingly from the recessed portion (initial deformation) formed by the frame-like portion 22 to progress. Therefore, since the deformation by the compression gas G2 is dispersed, local stress concentration is avoided, and a crack or a pin hole by a wrinkle or a fold can effectively be prevented from being brought about.

Figure 18:
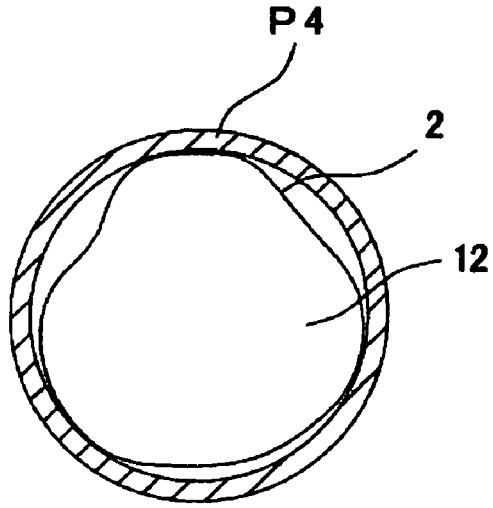
FIG. 18 is a bottom view showing a state of preventing a bottom portion of an inner bag from being deformed by peeping in a bottom face of the cap.
Figure 19:
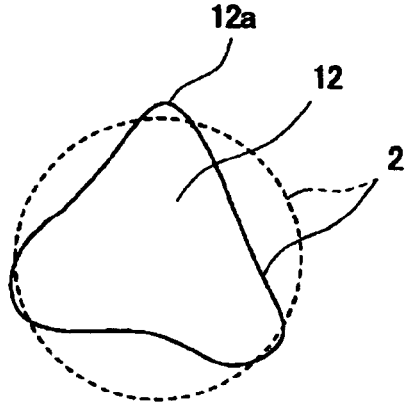
FIG. 19 is a bottom view showing a state of considerably deforming the bottom portion of the inner bag.
Figure 20:
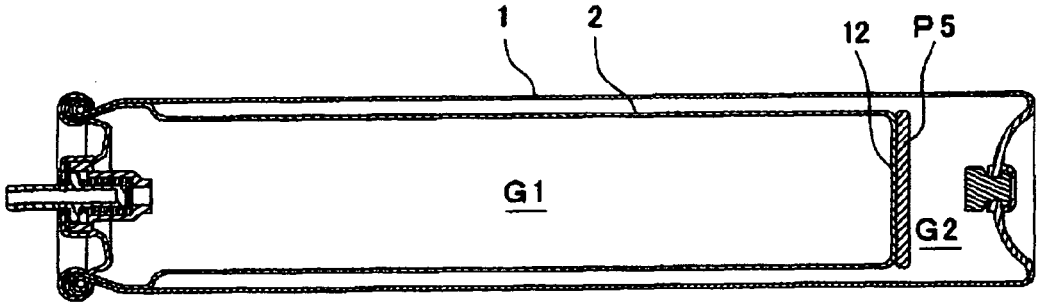
FIG. 20 is a vertical sectional view of a state of providing a deformation introducing member at the bottom portion of the inner bag.

Further, although the inner bag 2 is pressed to crush to deform by the compression gas G2 in accordance with consumption of the fuel gas G1, at that occasion, as shown by FIG. 22, the bottom portion 12 tends to be liable to be deformed to be pulled to the opening side to be rounded. When the bottom portion 12 is rounded, as shown by FIG. 19, a portion 12*a* of the bottom portion 12 is bulged to be extruded from an outer diameter thereof. However, since the bottom portion 12 of the inner bag 2 is fitted with the cap P4, as shown by FIG. 18, there is restrained a phenomenon of deforming a portion of the bottom portion 12 to be bulged to be rounded to be extruded from the outer diameter. Therefore, the initial deformation is introduced to carry out at other portion.

Further, as shown by 20, the deformation introducing member may be constructed by a constitution of adhering to fix a circular plate (or doughnut plate) P5 to an outer face of the bottom portion 12 of the inner bag 2.

In this case, even when the bottom portion 12 receives a force of being pressed to crush to deform by the compression gas G2, since the bottom portion 12 is reinforced by the reinforcement circular plate P5 and therefore, the phenomenon of deforming the bottom portion 12 to be rounded by bulging a portion of the bottom portion 12 to exclude from the outer diameter is restrained, and the initial deformation is introduced to carry out at other portion.

Third Exemplary Embodiment

Figure 21:
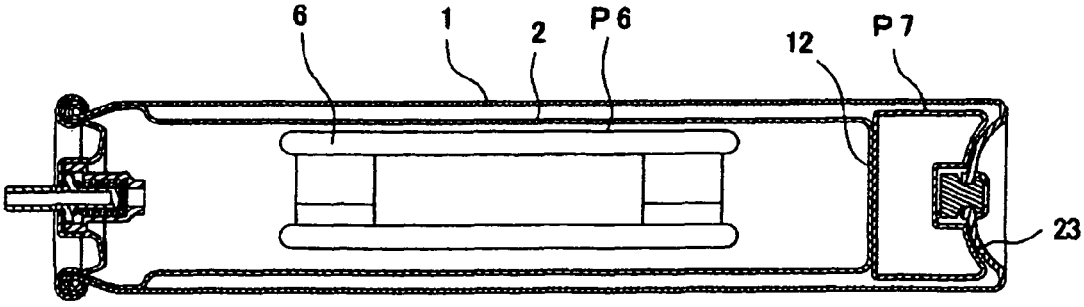
FIG. 21 is a vertical sectional view of a state of providing deformation introducing members to inside and outside of an inner bag according to a third exemplary embodiment.

The gas cartridge A according to a third embodiment of the invention will be explained as follows in reference to FIG. 21. The gas cartridge A is constituted by a mode in which deformation introducing members comprising synthetic resin, rubber, paper or the like are provided at inside and outside of the inner bag 2.

That is, inside of the inner bag 2 is arranged with a deformation introducing member comprising 3 pieces of parallel frames P6 having a constitution the same as that shown in FIG. 3 for preventing a portion of the inner bag 2 from being deformed when the press force of the compression gas G2 is received. At the same time, outside of the inner bag 2 is arranged with a deformation introducing member comprising a spacer P7 between the bottom portion 12 and a bottom portion 23 of the outer can 1.

According to the above-described constitution, when the inner bag 2 is pressed to crush by the compression gas G2, the deformation of the inner bag 2 is introduced such that a portion thereof excluding the frame portion 6 of the parallel frame P6 is initially recessed to deform, and therefore, the deformation by the compression gas G2 is not deviated to one portion. Further, the spacer P7 is adhered to fix to the bottom portion of the deformation introducing member P6 between the bottom portion 12 of the inner bag 2 and the bottom portion 23 of the outer can 1, the bottom portion 12 of the inner bag 2 is reinforced by the spacer P7, and therefore, difficult to be deformed. Therefore, the phenomenon of deforming a portion of the bottom portion 12 to be bulged to be rounded to be extruded from the outer diameter is restrained, and initial deformation is introduced to carry out at other portion.

In this way, the deformation is introduced from inside and outside of the inner bag 2, and therefore, local stress concentration is avoided.

Further, a combination of the deformation introducing members provided at inside and outside of the inner bag 2 is not limited to the above-described example but may be constituted by other combination.

A number of the frame portion 6 is not limited to 3 pieces. The number may be plural.

Although an explanation has been given of the invention in details and in reference to the specific embodiments, it is apparent for the skilled person that the invention can variously be changed or modified without deviating from the spirit and the range of the invention.

The application is based on Japanese Patent Application (Japanese Patent Application No. 2006-019119) filed on Jan. 27, 2006, Japanese Patent Application (Japanese Patent Application No. 2006-051086) filed on Feb. 27, 2006, Japanese Patent Application (Japanese Patent Application No. 2006-095386) filed on Mar. 30, 2006, Japanese Patent Application (Japanese Patent Application No. 2006-133662) filed on May 12, 2006, and Japanese Patent Application (Japanese Patent Application No. 2006-303323) filed on Nov. 8, 2006, and the contents thereof are incorporated herein by reference.

INDUSTRIAL APPLICABILITY

The invention is applicable to a gas cartridge for supplying a fuel gas used in a strike tool of a gas nailer or the like for striking a fastener of a nail, a screw or the like by a combustion pressure of the gas, or a gas cartridge for charging a cosmetic agent, an insect preventing agent, an insecticide or the like.

What is claimed is:

1. A gas cartridge comprising:

a metal made outer can;

a metal made inner bag arranged at inside of the outer can, in which a fuel gas is charged to inside of the metal made inner bag, and a space between the outer can and the inner bag is charged with a compression gas for pressing to crush the inner bag in accordance with consumption of the fuel gas; and a deformation introducing member that is a member separated from both of the outer can and the inner bag and provided on an inner side of the outer can for producing an initial deformation for introducing a deformation of the inner bag when a press force of the compression gas is received, wherein the deformation introducing member includes a first end portion and a second end portion between which a plurality of deformation introducing portions are connected and arranged at intervals, thereby forming a housing to accommodate the inner bag, and wherein radially inner parts of the plurality of deformation introducing portions are in contact with radially outer peripheral parts of the inner bag, respectively.

2. The gas cartridge according to claim 1, wherein the deformation introducing member is provided at inside of the inner bag, and produces the initial deformation at the inner bag by receiving the press force of the compression gas.

3. The gas cartridge according to claim 1, wherein the deformation introducing member is provided at outside of the inner bag, and produces the initial deformation at the inner bag by receiving a gas pressure of the charged gas.

4. The gas cartridge according to claim 1, wherein the deformation introducing members are provided at inside and outside of the inner bag, and produce the initial deformation at the inner bag by receiving the press force of the compression gas and a gas pressure of the charged gas.

5. The gas cartridge according to claim 3, wherein the plurality of deformation introducing portions are in a frame-like shape provided at the space between the inner bag and the outer can.

6. The gas cartridge according to claim 5, wherein an outer diameter of the inner bag including the deformation introducing member is larger than an inner diameter of the outer can.

7. The gas cartridge according to claim 1, wherein outer diameters of the first and second end portions are formed to be substantially the same as an inner diameter of the outer can.

8. A gas cartridge comprising:

a metal made outer can;

a metal made inner bag at inside of the outer can, in which a fuel gas is charged to inside of the inner bag, and a space between the outer can and the inner bag is charged with a compression gas for pressing to crush the inner bag in accordance with a consumption of the fuel gas; and a surrounding frame that is a member separated from both of the outer can and the inner bag and disposed between the outer can and the inner bag, wherein the surrounding frame includes a plurality of frame-like portions extending in a longitudinal direction of the inner bag and arranged at intervals to accommodate the inner bag, wherein radially inner parts of the plurality of frame-like portions are in contact with radially outer peripheral parts of the inner bag, respectively and wherein recessed portions are formed on the inner bag at positions where the radially inner parts of the frame-like portions are in contact with the radially outer peripheral parts of the inner bag.

9. The gas cartridge according to claim 8, wherein an outer diameter of the surrounding frame is formed to be substantially the same as an inner diameter of the outer can.

* * * * *